US008294634B2

(12) United States Patent
Weitbruch et al.

(10) Patent No.: US 8,294,634 B2
(45) Date of Patent: Oct. 23, 2012

(54) METHOD AND APPARATUS FOR AVOIDING OVERHEATING OF DRIVERS OF A PLASMA DISPLAY PANEL

(75) Inventors: Sébastien Weitbruch, Kappel (DE); Cédric Thebault, Villingen-Schwenningen (DE); Carlos Correa, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 982 days.

(21) Appl. No.: 11/709,005

(22) Filed: Feb. 20, 2007

(65) Prior Publication Data

US 2007/0200796 A1 Aug. 30, 2007

(30) Foreign Application Priority Data

Feb. 21, 2006 (EP) ..... 06290298

(51) Int. Cl.
*G09G 3/28* (2006.01)

(52) U.S. Cl. ..... 345/60

(58) Field of Classification Search ..... 345/60, 345/204

See application file for complete search history.

(56) References Cited

U.S. PATENT DOCUMENTS

2001/0033263 A1* 10/2001 Yamada et al. ..... 345/89
2002/0118312 A1* 8/2002 Ishizuka et al. ..... 348/797
2004/0258312 A1* 12/2004 Sim ..... 382/219
2005/0116893 A1* 6/2005 Joo ..... 345/60

FOREIGN PATENT DOCUMENTS

| | | |
|---|---|---|
| EP | 1381018 | 1/2004 |
| JP | 2000066638 | 3/2000 |
| WO | WO01/82284 | 11/2001 |
| WO | WO 0182284 A1 * | 11/2001 |

OTHER PUBLICATIONS

Search Report dated Jul. 25, 2006.

* cited by examiner

*Primary Examiner* — Bipin Shalwala
*Assistant Examiner* — Carolyn R Edwards
(74) *Attorney, Agent, or Firm* — Tutunjian & Bitetto, P.C.

(57) ABSTRACT

Overheating while enabling a full flexibility in the display usage should be avoided. This object is solved by a method for avoiding the overheating of a driver circuit in a plasma display panel wherein the driver circuit receives serially display data in form of a sequence of sub-field data bits and forwards parallelly the display data in the form of data blocks each consisting of a predefined number of sub-field data bits, the method comprising the steps of counting sub-field data bits the value of which differs from that of a neighboring or preceding sub-field data bit and providing a respective counting signal indicative of heat contributions of sub-field data bits and, if said counting signal is above a pregiven threshold, taking countermeasures for reducing said temperature.

26 Claims, 6 Drawing Sheets

METHOD AND APPARATUS FOR AVOIDING OVERHEATING OF DRIVERS OF A PLASMA DISPLAY PANEL

This application claims the benefit, under 35 U.S.C. §119 of EP Patent Application 06290298.6 filed 21 Feb. 2006.

FIELD OF THE INVENTION

The invention relates to a method for driving a plasma display panel including the steps of serially receiving display data in form of a sequence of subfield data bits and parallelly forwarding the display data in the form of data blocks each consisting of a pre-defined number of sub-field data bits. Furthermore, the present invention relates to a corresponding apparatus for driving a plasma display panel.

BACKGROUND OF THE INVENTION

FIG. 1 shows the principal structure of the electronics of a known plasma display panel (PDP).

A video signal is sent to a Digital Board 1 that includes the heart of the PDP processing: the PDP IC controller. This IC takes care of all PDP relevant signal processing and converts video data to sub-field information as usual. Furthermore, the IC is responsible for sending all power signals to the hardware including:

- data drivers D1 to D6 of a PDP 2 for sending on the vertical electrodes the bits (1 or 0) for all cells 3 of the current selected lines,
- line drivers L1, L2, L3 for selecting lines to be written one after the other and
- a common part 4 for generating global signals (in combination with the line drivers) like sustain, erase, priming.

As shown in FIG. 1, the PDP cell 3 is defined as the crossing point between a vertical electrode coming from a data driver output D1, a horizontal electrode coming from a line driver output L1 and an horizontal electrode coming from the Common electronic 4. The data drivers D1 to D6 are serial to parallel converters as described in connection with FIG. 2. Each data driver Dk (n outputs), receives n sub-field data bits (Cn,t) of line t serially from the PDP IC controller. The input occurs at a frequency defined by clk.

On each starting edge of the enable signal ENA, the n outputs of the driver Dk take the n values stored from the PDP IC. In fact when data $C_{n,t}$ are send to the input of the driver Dk, the outputs take the values $C_{n,t-1}$. The enable signal ENA is included in the addressing signal used to activate the current line t−1. An important point is that the input signals are control logic signals (low voltage) whereas the output signals are power signals (high power ≅60V).

The activity of the driver Dk is defined by two important points:

- The activity at the input of the driver: how many changes are occurring during the loading of a driver?
- The activity at the output of the driver: how many outputs are changing from one line to another? Furthermore, it is important to notice how these changes are appearing. Indeed if all outputs have the same value and are changing in one time, this is less energy consuming than if each output is different and is changing.

Based on all these assumptions, a critical test pattern can be defined per driver as illustrated in FIG. 3.

The pattern will introduce an overheating of the driver and above all when the addressing speed is fast (clk and ENA are high frequency signals) like for high-resolution displays. If the driver is overheated a long time (many frames) it can be definitely damaged. Moreover, today, the drivers are bonded on the PDP glass by using glue and it is almost impossible to remove them in order to perform an exchange. Therefore, if a driver has been damaged, the whole panel can be thrown away.

Today, in order to avoid such a problem, there are three possibilities:

- A technical one that tries to avoid such an overheating by limiting either the addressing speed (clk and ENA frequencies are low), or the number of sub-fields used per frame.
- A coding one that tries to use a specific coding that should reduce the situation depicted in FIG. 3 for a standard picture (reduce the toggling inside a codeword).
- A signal-processing one that tries directly to detect critical patterns in order to reduce the number of sub-fields used during addressing.

A typical real pattern introducing the problem of FIG. 3 is shown in FIG. 4.

The problem is that, even if this pattern is a seldom one and could mainly appear only in case of PC applications, the display should be made robust enough in order not to be destroyed. This needs solutions as those described just before. The problem is that such solutions do not cover all possibilities or all risks. Moreover, some solutions (e.g. coding ones) are limiting the flexibility of the display that can have an impact on the picture quality (e.g. less sub-fields or not optimized coding).

SUMMARY OF THE INVENTION

It is the object of the present invention to avoid overheating while enabling a full flexibility in the display usage.

According to the present invention this object is solved by a method for avoiding the overheating of a driver circuit in a plasma display panel wherein the driver circuit receives serially display data in form of a sequence of sub-field data bits and forwards parallelly the display data in the form of data blocks each consisting of a predefined number of sub-field data bits, the method comprising the following steps

- counting sub-field data bits the value of which differs from that of a neighbouring or preceding sub-field data bit and providing a respective counting signal representative of the temperature of said driver circuit and,
- if said counting signal is above a pregiven threshold, taking countermeasures for reducing said temperature.

Furthermore, there is provided a method for avoiding the overheating of a driver circuit in a plasma display panel wherein the driver circuit receives serially display data in form of a sequence of sub-field data bits and forwards parallelly the display data in the form of data blocks each consisting of a predefined number of sub-field data bits, the method comprising the following steps

- determining transition information for each sub-field data bit, the transition information representing a relation between the value of the sub-field data bit and the value of a neighbouring sub-field data bit,
- counting sub-field data bits the value of which differs from that of a neighbouring or preceding sub-field data bit and/or the transition information the value of which differs from that of a preceding sub-field data bit and providing a respective counting signal representative of the temperature of said driver circuit and,
- if said counting signal is above a pregiven threshold, taking countermeasures for reducing said temperature.

Moreover, the above object is solved by an apparatus for avoiding the over-heating of a driver circuit in a plasma display panel wherein the driver circuit receives serially display data in form of a sequence of sub-field data bits and forwards parallelly the display data in the form of data blocks each consisting of a predefined number of sub-field data bits, the apparatus including counting means for counting sub-field data bits the value of which differs from that of a neighbouring or preceding sub-field data bit and for providing a respective counting signal representative of the temperature of said driver circuit and, controlling means for taking countermeasures for reducing said temperature if said counting signal is above a pre-given threshold.

Finally, according to the present invention there is provided an apparatus for avoiding the overheating of a driver circuit in a plasma display panel wherein the driver circuit receives serially display data in form of a sequence of sub-field data bits and forwards parallelly the display data in the form of data blocks each consisting of a predefined number of sub-field data bits, the apparatus including data processing means for determining transition information for each sub-field data bit, the transition information representing a relation between the value of the sub-field data bit and the value of a neighbouring sub-field data bit, counting means for counting sub-field data bits the value of which differs from that of a neighbouring or preceding sub-field data bit and/or the transition information the value of which differs from that of a preceding sub-field data bit and for providing a respective counting signal representative of the temperature of said driver circuit, controlling means for taking countermeasures for reducing said temperature if said counting signal is above a pre-given threshold.

Thus, there is provided a solution that is quiet robust in order to avoid any data driver overheating while enabling a full flexibility in the display usage (as many sub-fields as needed, fastest possible addressing, fully optimized coding etc.). Preferably, an input counter is incremented, if the value of a received sub-field data bit is different from the neighbouring sub-field data bit received previously. Thus, the number of changes occurring during the loading of a driver can be regarded.

Furthermore, an output counter may be incremented, if the value of a sub-field data bit of a data block is different from the corresponding sub-field data bit of the preceding data block. Alternatively or additionally, a stage counter may be incremented, if the transition information of a sub-field data bit of a data block is different from the corresponding sub-field data bit of the preceding data block. With that, the activity of the output of the driver, i.e. how many outputs are changing from a one line to another, can be regarded.

Advantageously, taking countermeasure includes generating an overheat signal for optionally reducing the gain of the plasma display panel or the number of sub-fields used per frame on the basis of the counter values of at least two counters of the input counter, the output counter and the stage counter. So, a helpful value as to the level of overheating can be produced. If a plasma display device includes plural driving apparatuses as described above, each associated to a driver circuit of the display panel, an overheat signal should be generatable for each apparatus and the gain or the number of sub-fields should be reducible, if the overheat signal of one single apparatus exceeds a pre-given threshold, each overheat signal of more than a pre-given number of apparatuses exceeds the pre-given threshold or each overheat signal of more than a pre-given number of neighbouring apparatuses exceeds the pre-given threshold. This leads to a reliable decision on the status of overheating.

BRIEF DESCRIPTION OF THE DRAWINGS

Exemplary embodiments of the invention are illustrated in the drawings and are explained in more detail in the following description. The drawings showing in FIG. 1 an overall PDP electronic structure, FIG. 2 a data driver principal, FIG. 3 a critical test pattern, FIG. 4 a critical video pattern, FIG. 5 an emulator block, and FIG. 6 the concept of an implementation of a plasma display panel according to the present invention.

DETAILED DESCRIPTION OF THE PREFERRED EMBODIMENTS

In order to provide a robust system for avoiding any data driver overheating, each driver of a driver system is emulated inside the PDP IC controller by a block called $EMU_DR_k$ where k represents the number of the driver. Such a block is described in FIG. 5.

Each information $C_{x,t}$ used for evaluating the heating contribution contains two types of information:

Its value—0 or 1 and its horizontal transition to previous $C_{x-1,t}$ having three possible stages: <, =, >.

Figure 5:
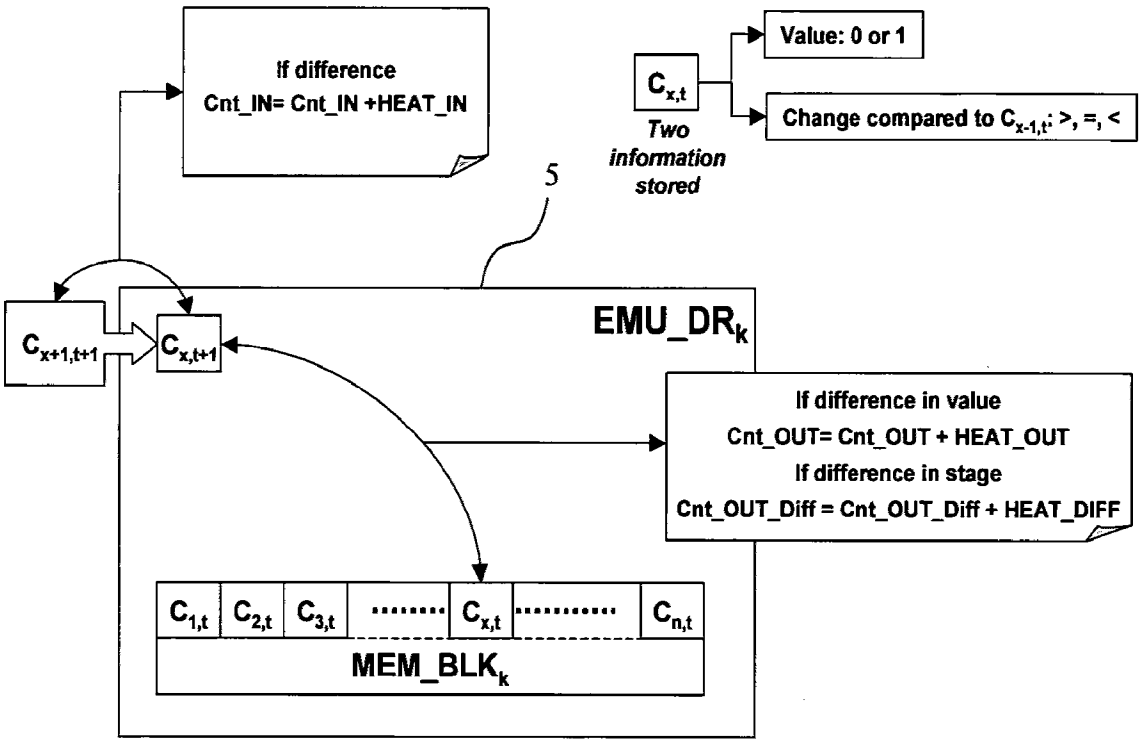

The emulator block 5 illustrated in FIG. 5 is a complex counter that will evaluate for each driver:

The activity of the input by counting the number of differences between two consecutive, i.e. horizontally neighbouring inputs $C_{x,t+1}$, and $C_{x+1,t+1}$. Each time that a transition is detected (1→0 or 0→1), the input counter $Cnt_IN_k$ is increased by a value HEAT_IN representing the impact of heating due to such a transition on driver Dk.

The activity of the output by storing in a memory $MEM_BLK_k$ the data of a complete driver output data block (e.g. 96 values in case of 96 outputs). Each time a new data $C_{x,t+1}$ is coming, this will replace the former $C_{x,t}$ in the memory and a counter called $Cnt_OUT_k$ is increased by value HEAT_OUT if $C_{x,t+1}$, and $C_{x,t}$ are different in value. Respectively, a counter Cnt_OUT_DIFF is increased by value HEAT_DIFF if the stage of $C_{x,t+1}$ and $C_{x,t}$ are different (e.g. changing from < to = . . . etc.). The value HEAT_OUT and HEAT_OUT_DIFF represent the heat contribution of the output toggling.

A general heating counter $HEAT_k = Cnt_IN_k + Cnt_OUT_k + Cnt_OUT_DIFF_k$ represents the heat of the driver Dk. This driver is reset on each new output frame based on the vertical synchronism signal V. This value is compared with a threshold OVERHEAT.

Now it is possible to react when:

(1) One single driver Dk is overheated having $HEAT_k$>OVERHEAT (2) More than p different drivers have $HEAT_k$>OVERHEAT (3) More than p neighbouring drivers have $HEAT_m$>OVERHEAT with $m \in [k-p;k]$.

It is possible to use all 3 conditions by using different thresholds OVERHEAT 1, OVERHEAT 2 and OVERHEAT 3, wherein OVERHEAT 1>OVERHEAT 2>OVERHEAT 3.

The final decision if an overheating occurs or not is based on the three possibilities listed above. This decision is programmable depending on electronic behaviour.

As soon as the overheating has been detected some modification of the addressing concept should be applied to reduce the overheating. However, the overheating problem is not a "punctual" problem appearing on only one frame and able to destroy the panel during this frame. This means that only when the overheating exists during a long time such a problem may appear.

Therefore, the number of frames having an overheating shall be counted. The detection will be done as following:

When one of the three overheat criteria has been detected (1), (2) or (3), OVERHEAT_FRAME is incremented. (Here also one can use all three conditions by using OVERHEAT FRAME 1, OVERHEAT FRAME 2, OVERHEAT FRAME 3.

As soon as the overheat criteria is no more valid, the OVERHEAT_FRAME is decremented.

When OVERHEAT_FRAME has been decremented down to 0, it won't be decremented anymore (0 is the minimum value for this counter).

When OVERHEAT_FRAME reaches OVERHEAT_DANGER then the real countermeasures will be applied. OVERHEAT_FRAME can for instance be incremented up to 2×OVERHEAT_DANGER+MARGIN (this is the maximum value reached by OVERHEAT_FRAME counter). MARGIN is a parameter that can be either positive or negative.

As soon as the danger has been detected, a counter measure is applied. The countermeasure should avoid a high activity in the data driver per frame. A possibility is to reduce the number of sub-fields used per frame in case of danger.

In order to do that, it is important to notice that the highest video level in a frame defines the maximal number of sub-fields used for this frame. Indeed, to encode the level 255 all sub-fields must be switched on. On the opposite, to encode the level 64, only a reduced amount of sub-fields is used.

The concept to reduce the driver overheating when a danger has been detected is based on a reduction of the signal amplitude of the incoming video. This is done by using a multiplier (like for contrast) with a gain lower than 1. In that case, the maximal video level is reduced leading to a need of fewer sub-fields.

The reduction will be done very slowly to avoid any visible picture change. This reduction will continue as long as the OVERHEAT_FRAME>OVERHEAT_DANGER. As soon as this situation has gone, the video gain will be modify slowly back to 1. The aim is to adjust the gain automatically to have OVERHEAT_FRAME just below OVERHEAT_DANGER.

Furthermore, a hysteresis function should be added on the gain change to avoid any oscillations even if those are quite invisible.

Figure 6:
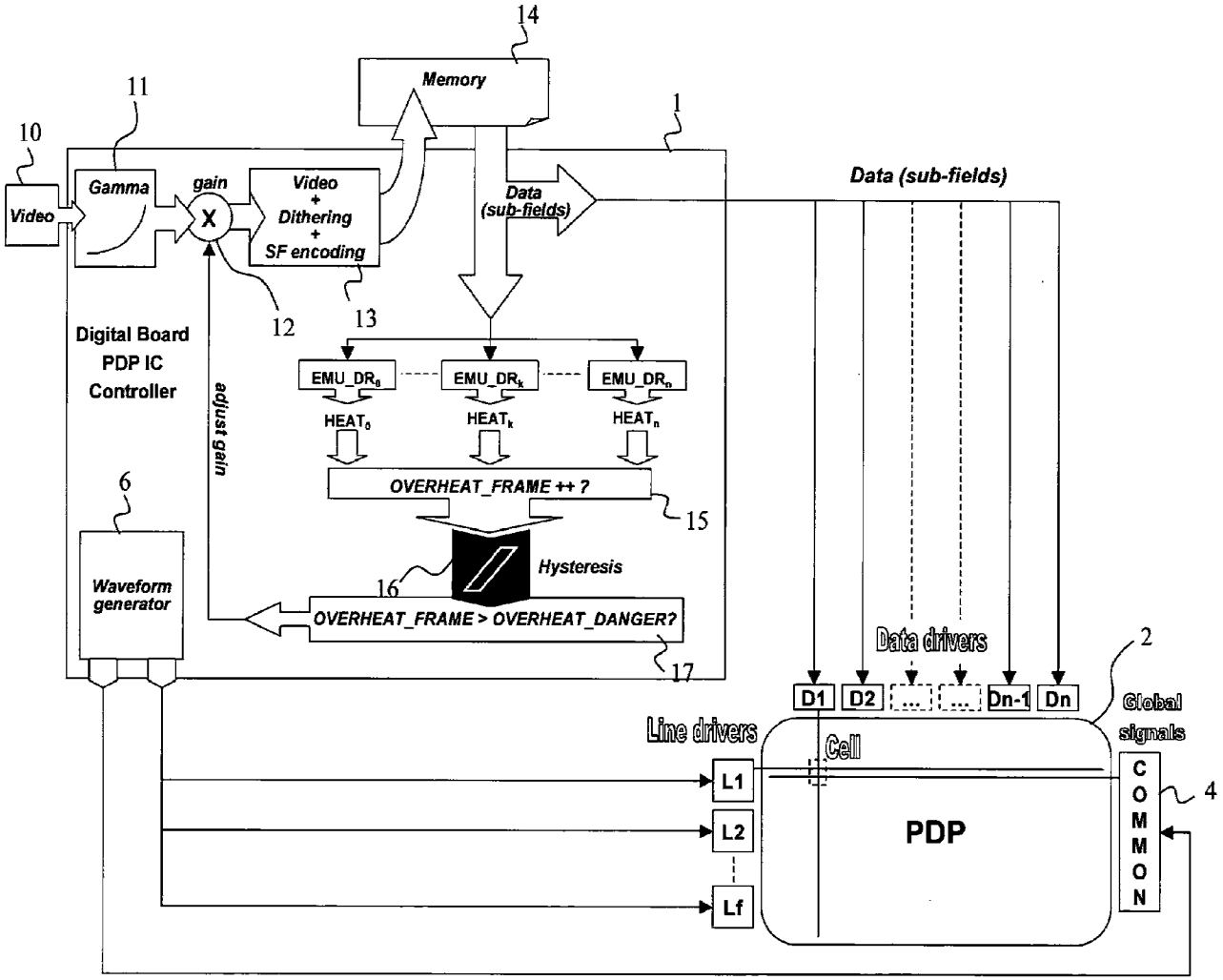

FIG. 6 illustrates a possible implementation of the above described solution.

Figure 1:
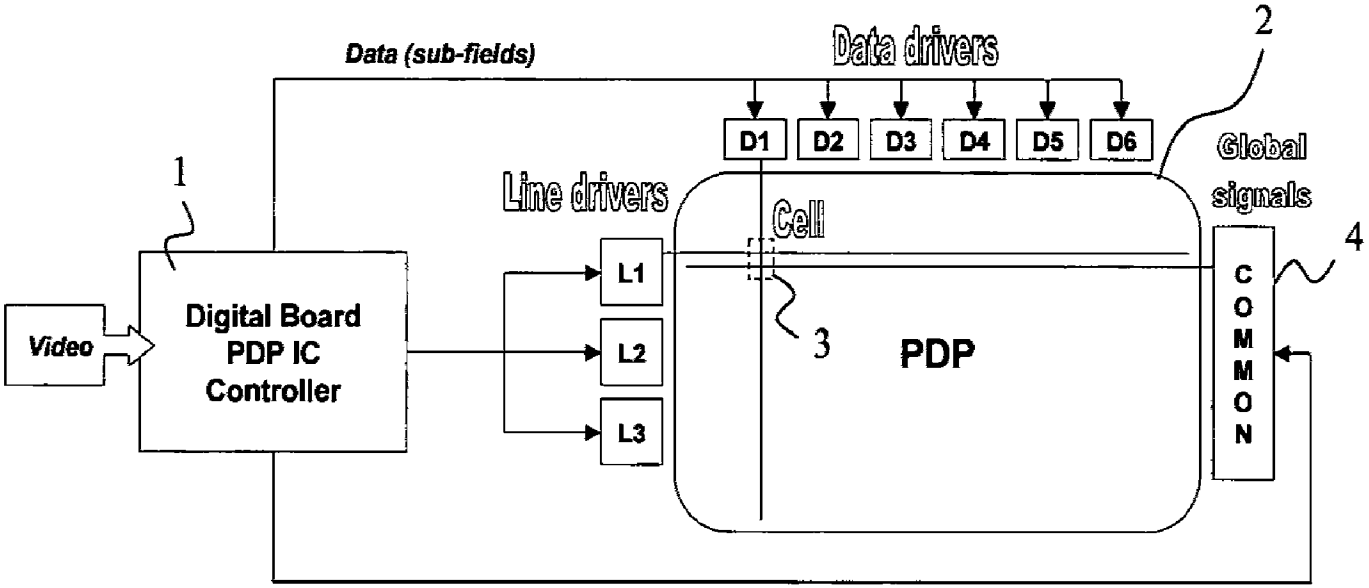
Figure 2:
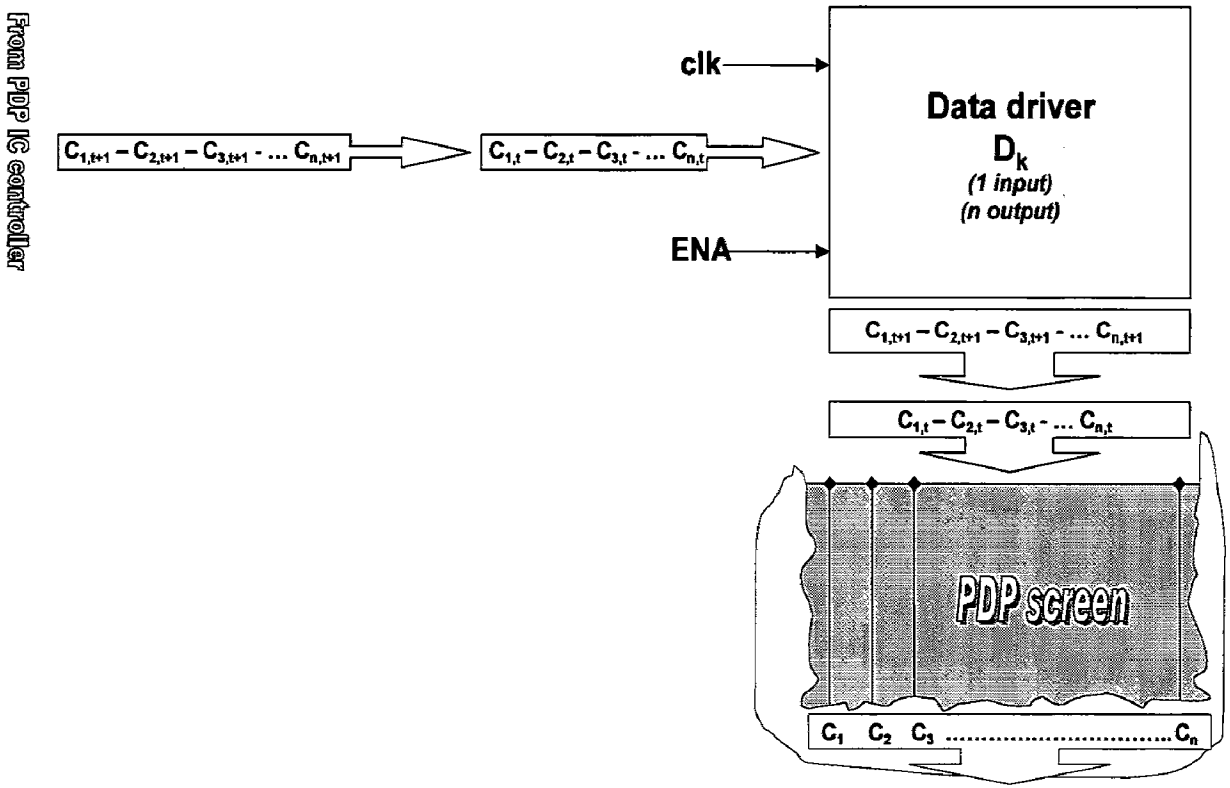
Figure 3:
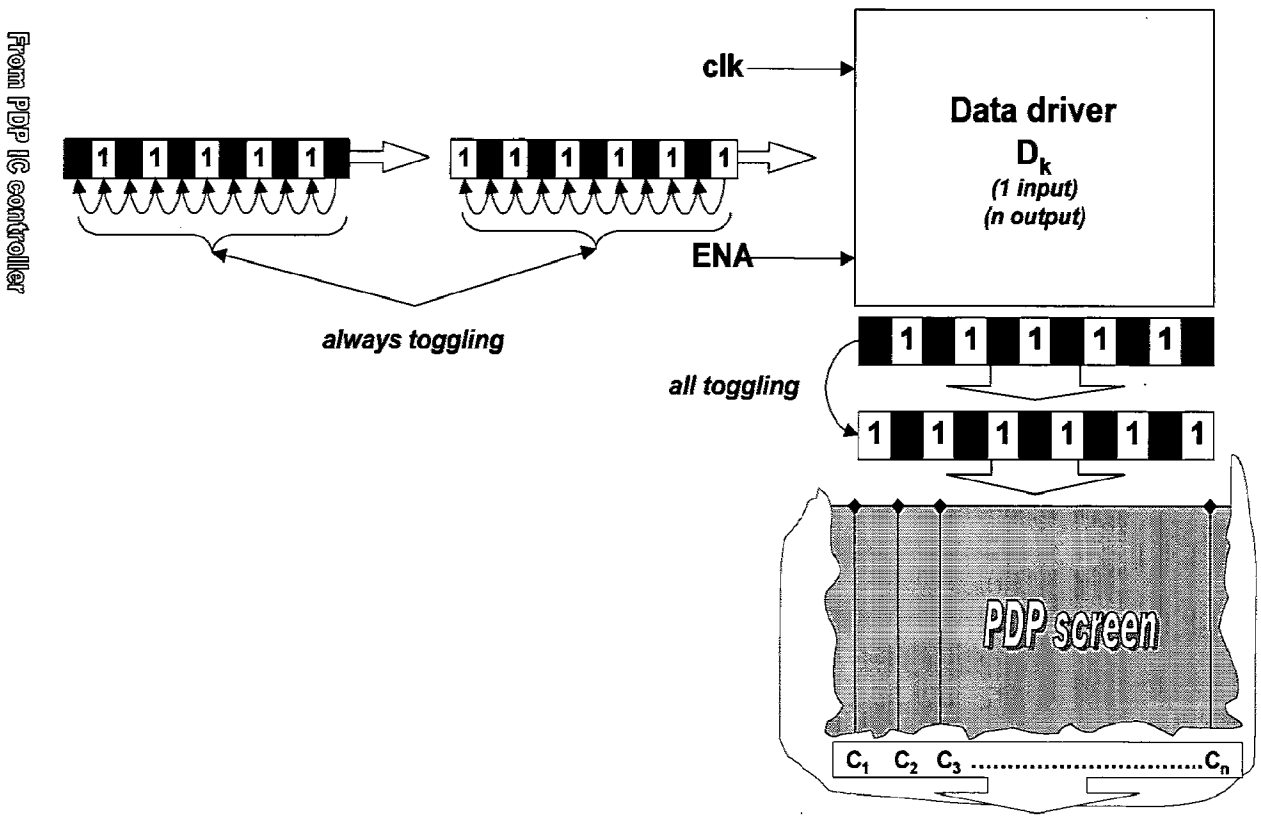

A digital board 1 controls the PDP 2 roughly in the same principal as illustrated in FIG. 1. Therefore, as to the data drivers D1 to Dn, the line drivers L1 to Lf at the common part 4 it is referred to the description of FIG. 1. However, according to FIG. 6, the line drivers L1 to Lf and the common part 4 are specifically driven by a wave form generator 6 being included in the digital board 1. The video input signal 10 is forwarded to a gamma transformation block 11 where the following operation is applied: $I_{out}=(I_{in})^{\gamma}$ usually with $\gamma=2.2$. The output of this block 11 goes through the new gain multiplier 12 required to adjust the signal amplitude to the driver heating. If not multiplier is used another solution to reduce the amount of sub-fields is also possible but less efficient.

Then its output is forwarded to the standard PDP functions 13 including video functions, dithering and sub-field encoding. The encoded information is stored sub-fields wise and pixel wise inside a frame memory 14.

The output of this frame memory 14 is read sub-field wise and line wise and sent to the data drivers D1 to Dn and at the same time to the driver heating emulation blocks $EMU_DR_k$, wherein $0 \leqq k \leqq n$. Each of this block evaluating the value $HEAT_k=Cnt_IN_k+Cnt_OUT_k$. Optionally, the counter $CNT_OUT_DIFF_k$ can also be added to the value $HEAT_k$. This value is then provided to controlling means for taking countermeasures for reducing the temperature of the data driver Dk if the value $HEAT_k$ is above a pregiven threshold.

All the outputs of these emulators are collected and analyzed to determine if the counter OVERHEAT_FRAME 15 must be incremented or decremented according methods (1), (2) or (3). This value is filtered by means of a hysteresis functions 16 to reduce jumps and oscillations.

Finally, depending on a comparison 17, if the value OVERHEAT_FRAME is bigger or lower than OVERHEAT_DANGER, the gain of multiplier 12 located directly after gamma block 11 is correspondingly decreased or increased.

The advantage of this solution is to avoid any loss of video information compared to a simple sub-field suppression (and also to avoid loss of gray-scale quality). Alternatively, the video gain may be before the gamma block 11 and therefore also before an APL measurement (not shown). Then, by reducing the gain, the APL is reduced and the number of sustains is increased by the standard PDP power management resulting in a quite stable light output. Only the grayscale dynamic is reduced here.

In order to improve the concept a low-pass filtering in the time domain could be applied on the gain to avoid oscillation following the encoding approach used. In that case the real gain will be defined as following:

$$Gain_{used} = \frac{1}{T} \cdot \sum_{t=t0}^{t=t0+T} \mathrm{Gain}(t).$$

Figure 4:
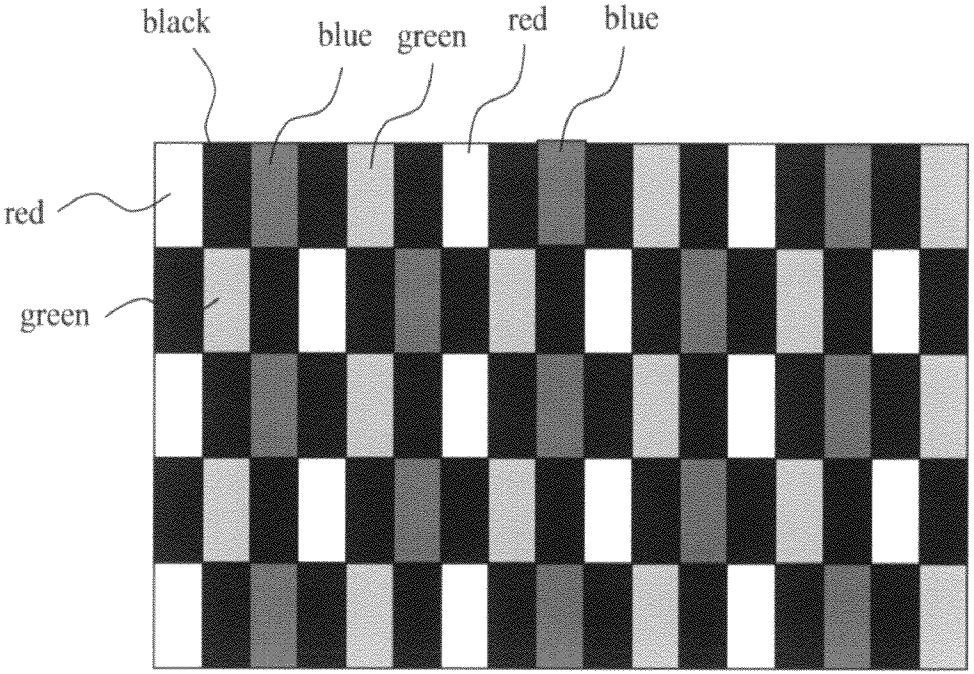

By increasing the value T, the influence of specific coding methods is reduced without introducing additional risks for the driver heat problem as long as T is shorter than the maximal heating time (time after that the driver temperature has reached a critical point in case of a critical test pattern shown in FIG. 4).

A further improvement against critical sequences can be realized optionally. When a danger has been detected a specific spatial filtering can be implemented on the picture before the gain function as described below:

$$\begin{vmatrix} \frac{1}{8} & 0 & \frac{1}{8} \\ 0 & \frac{1}{2} & 0 \\ \frac{1}{8} & 0 & \frac{1}{8} \end{vmatrix}.$$

This exemplary function will reduce the critical differences as shown in FIG. 4 but introduces a minimal reduction of sharpness. It is an optional concept that can be activated depending on the system integrator or automatically if the OVERHEAT_FRAME reaches a very high value OVERHEAT_STRONG_DANGER.

The invention claimed is:

1. Method for avoiding the overheating of an individual driver circuit in a plasma display panel wherein the driver circuit receives serially display data in form of a sequence of sub-field data bits and forwards the display data in parallel in data blocks each consisting of a predefined number of sub-field data bits, the method comprising the following steps:

computing a signal representative of the temperature of said individual driver circuit by counting sub-field data bits the value of which differs from that of a neighboring and preceding sub-field data bit and providing said signal representative of the temperature of said individual driver circuit and, if said counting signal is above a predefined threshold, taking countermeasures for reducing said temperature, said counter measures comprising generating an overheat signal for reducing the number of sub-fields used per frame on the basis of the counter values of at least two counters of an input counter, an output counter and a stage counter.

2. Method according to claim 1, wherein the input counter is incremented, if the value of a received sub-field data bit is different from the neighbouring sub-field data bit received previously.

3. Method according to claim 1, wherein the output counter is incremented, if the value of a sub-field data bit of a data block is different from the corresponding sub-field data bit of the preceding data block.

4. Method according to claim 2, wherein the output counter is incremented, if the value of a sub-field data bit of a data block is different from the corresponding sub-field data bit of the preceding data block.

5. Method according to claim 4, wherein taking countermeasures alternatively includes generating an overheat signal for reducing the gain of the plasma display panel.

6. Method for avoiding the overheating of an individual driver circuit in a plasma display panel wherein the driver circuit receives serially display data in form of a sequence of sub-field data bits and forwards the display data in parallel in the form of data blocks each consisting of a predefined number of sub-field data bits, the method comprising the following steps:

determining transition information for each sub-field data bit, the transition information representing a relation between the value of the sub-field data bit and the value of a neighboring sub-field data bit, computing a signal representative of the temperature of said individual driver circuit by counting sub-field data bits the value of which differs from that of a neighboring and preceding sub-field data bit and providing said signal representative of the temperature of said individual driver circuit and, if said counting signal is above a predetermined threshold, taking countermeasures for reducing said temperature, said taking a countermeasure comprising reducing the number of sub-fields used per frame on the basis of the counter values of at least two counters of an input counter, an output counter and a stage counter.

7. Method according to claim 6, wherein the input counter is incremented, if the value of a received sub-field data bit is different from the neighbouring sub-field data bit received previously.

8. Method according to claim 6, wherein the output counter is incremented, if the value of a sub-field data bit of a data block is different from the corresponding sub-field data bit of the preceding data block.

9. Method according to claim 6, wherein the stage counter is incremented, if the transition information of a sub-field data bit of a data block is different from the corresponding sub-field data bit of the preceding data block.

10. Method according to claim 7, wherein the output counter is incremented, if the value of a sub-field data bit of a data block is different from the corresponding sub-field data bit of the preceding data block.

11. Method according to claim 10, wherein the stage counter is incremented, if the transition information of a sub-field data bit of a data block is different from the corresponding sub-field data bit of the preceding data block.

12. Method according to claim 11, wherein taking countermeasures alternatively includes generating an overheat signal for reducing the gain of the plasma display panel.

13. Apparatus for avoiding the overheating of an individual driver circuit in a plasma display panel wherein the individual driver circuit receives serially display data in form of a sequence of sub-field data bits and forwards the display data in parallel in data blocks each consisting of a predefined number of sub-field data bits, characterized in that it includes computing means for computing a signal representative of the temperature of said driver circuit by counting sub-field data bits the value of which differs from that of a neighboring and preceding sub-field data bit and for providing a respective counting signal representative of the temperature of said individual driver circuit and, controlling means for taking countermeasures for reducing said temperature if said counting signal is above a predefined threshold, said controlling means including a signal processing means for generating an overheat signal for reducing the number of the sub-fields used per frame on the basis of the counter values of at least two counters of an input counter, an output counter and a stage counter.

14. Apparatus according to claim 13, wherein the counting means includes the input counter being incrementable, if the value of a received sub-field data bit is different from the neighbouring sub-field data bit received previously.

15. Apparatus according to claim 13, wherein the counting means includes the output counter being incrementable, if the value of a sub-field data bit of a data block is different from the corresponding sub-field data bit of the preceding data block.

16. Apparatus according to claim 14, wherein the counting means includes the output counter being incrementable, if the value of a sub-field data bit of a data block is different from the corresponding sub-field data bit of the preceding data block.

17. Apparatus according to claim 16, wherein the signal processing means alternatively generates an overheat signal for reducing the gain of the plasma display panel.

18. Apparatus for avoiding the overheating of an individual driver circuit in a plasma display panel wherein the individual driver circuit receives serially display data in form of a sequence of sub-field data bits and forwards the display data in parallel in data blocks each consisting of a predefined number of sub-field data bits, characterized in that it includes data processing means for determining transition information for each sub-field data bit, the transition information representing a relation between the value of the sub-field data bit and the value of a neighboring sub-field data bit, computing means for computing a signal representative of the temperature of said individual driver circuit by counting the sub-field data bits the value of which differs from that of a neighboring and preceding sub-field data bit and providing said signal representative of the temperature of said individual driver circuit, and controlling means for taking countermeasures for reducing said temperature if said counting signal is above a predefined threshold, said controlling means including a signal processing means for generating an overheat signal for reducing the number of the sub-fields used per frame on the basis of the counter values of at least two counters of an input counter, an output counter and a stage counter.

19. Apparatus according to claim 17, wherein the counting means includes the input counter being incrementable, if the value of a received sub-field data bit is different from the neighbouring sub-field data bit received previously.

20. Apparatus according to claim 17, wherein the counting means includes the output counter being incrementable, if the value of a sub-field data bit of a data block is different from the corresponding sub-field data bit of the preceding data block.

21. Apparatus according to claim 17, wherein the counting means includes the stage counter being incrementable, if the transition information of a sub-field data bit of a data block is different from the corresponding sub-field data bit of the preceding data block.

22. Apparatus according to claim 18, wherein the counting means includes the output counter being incrementable, if the value of a sub-field data bit of a data block is different from the corresponding sub-field data bit of the preceding data block.

23. Apparatus according to claim 19, wherein the counting means includes the stage counter being incrementable, if the transition information of a sub-field data bit of a data block is different from the corresponding sub-field data bit of the preceding data block.

24. Apparatus according to claim 23, wherein the signal processing means alternatively generates an overheat signal for reducing the gain of the plasma display panel.

25. Plasma display device including a display panel and plural apparatuses according to claim 17, each apparatus being associated to an individual driver circuit of the display panel wherein an overheat signal is generated if said counting signal is above a predefined threshold for each apparatus and the gain or the number of sub-fields is reducible if said overheat signal of one single apparatus exceeds a pre-given threshold, each overheat signal of more than a pre-given number of apparatuses exceeds said predefined threshold or each overheat signal of more than a pre-given number of consecutive apparatuses exceeds said predefined threshold.

26. Plasma display device including a display panel and plural apparatuses according to claim 25, each apparatus being associated to an individual driver circuit of the display panel wherein an overheat signal is generated if said counting signal is above a predefined threshold for each apparatus and the gain or the number of sub-fields is reducible if said overheat signal of one single apparatus exceeds the predefined threshold, each overheat signal of more than a predefined number of apparatuses exceeds said predefined threshold or each overheat signal of more than a predefined number of consecutive apparatuses exceeds said predefined threshold.

* * * * *